US010828522B2

(12) United States Patent
Rohman et al.

(10) Patent No.: US 10,828,522 B2
(45) Date of Patent: Nov. 10, 2020

(54) NEUTRALIZATION METHOD USING REACTIVE ENERGETIC MATERIALS

(71) Applicant: MATSYS INC., Sterling, VA (US)

(72) Inventors: Stephen Rohman, Purcellville, VA (US); Tony F. Zahrah, Fairfax Station, VA (US); Pascal Dubé, Aldie, VA (US)

(73) Assignee: MATSYS INC., Sterling, VA (US)

( * ) Notice: Subject to any disclaimer, the term of this patent is extended or adjusted under 35 U.S.C. 154(b) by 8 days.

(21) Appl. No.: 16/391,844

(22) Filed: Apr. 23, 2019

(65) Prior Publication Data

US 2019/0321671 A1 Oct. 24, 2019

Related U.S. Application Data

(60) Provisional application No. 62/661,401, filed on Apr. 23, 2018.

(51) Int. Cl.

| | |
|---|---|
| ***A62D 3/38*** | (2007.01) |
| ***C06B 21/00*** | (2006.01) |
| ***B22F 9/04*** | (2006.01) |
| *A62D 101/06* | (2007.01) |

(52) U.S. Cl.

CPC ..... *A62D 3/38* (2013.01); *B22F 9/04* (2013.01); *C06B 21/0091* (2013.01); *A62D 2101/06* (2013.01); *B22F 2009/041* (2013.01); *B22F 2301/052* (2013.01); *B22F 2301/058* (2013.01); *B22F 2301/155* (2013.01); *B22F 2301/205* (2013.01); *B22F 2301/30* (2013.01); *B22F 2301/355* (2013.01); *B22F 2301/40* (2013.01); *B22F 2303/00* (2013.01)

(58) Field of Classification Search

CPC ..... A62D 3/38; A62D 2101/06; B22F 9/04; B22F 2009/041; B22F 2301/052; B22F 2301/058; B22F 2301/155; B22F 2301/205; B22F 2301/30; B22F 2301/355; B22F 2301/40; B22F 2303/00; C06B 21/0091

USPC ..... 588/320

See application file for complete search history.

(56) References Cited

U.S. PATENT DOCUMENTS 6,777,586 B1 * 8/2004 Arcuri ..... C06B 21/0091 149/109.6

* cited by examiner

*Primary Examiner* — Edward M Johnson

(74) *Attorney, Agent, or Firm* — Oblon, McClelland, Maier & Neustadt, L.L.P.

(57) ABSTRACT

Formulations of reactive materials, such as aluminum, magnesium and alloys thereof, with combustible additives such as wood derivatives or charcoal, provide a composition for neutralizing energetic materials via combustion. Specifically, explosive substances such as ammonium nitrate and urea nitrate, which are commonly used as homemade explosives, are rapidly incinerated in a non-propagating manner by the contact with burning reactive material formulations.

12 Claims, 7 Drawing Sheets
(7 of 7 Drawing Sheet(s) Filed in Color)

FIG. 4

| AN Mass (lbs) | Evap (wt %) |
|---|---|
| 5 | 99.8 |
| 10 | 98.5 |
| 20 | 97.5 |
| 30 | 98.0 |
| 40 | 97.5 |
| 50 | 98.4 |

NEUTRALIZATION METHOD USING REACTIVE ENERGETIC MATERIALS

STATEMENT REGARDING FEDERALLY SPONSORED RESEARCH OR DEVELOPMENT

The invention was made with government support under contracts #W15QKN-14-9-1001 and DOTC-17-01-0405 awarded by the U. S. Army ARDEC. The government has certain rights in the invention.

BACKGROUND

Field of the Invention

This invention relates to a method to neutralize and dispose of explosives, propellants, pyrotechnics and other highly energetic materials. More specifically, it provides an efficient and effective method to rapidly dispose of such energetic materials by treatment with reactive material mixtures and formulations thereof.

Description of the Related Art

Increasing proliferation of energetic materials (EMs) poses significant threats to national security. Unregulated EM production is exemplified by their use by terrorist organization worldwide to inflict damage to civilian and military personnel. Controlled and regulated production of EM has been supporting a variety of civilian and military activities, ranging from the preparation of munitions to explosives for the mining industry. Beyond their intended use, there are four established methods to dispose or destroy energetic materials when either found by law enforcement agencies or soldiers on the battlefield. These methods are namely: deflagration or incineration of the energetic material, controlled detonation, dilution by a solvent or foreign substance, or direct chemical destruction. However, each method possesses severe drawbacks that make them impractical or limiting, especially, when expediency is needed, either on the battlefield or populated urban areas.

Common incineration is time intensive, often requiring long burn times. Moreover, many energetic materials, such as ammonium nitrate (AN) and urea nitrate (UN), melt upon heating, severely complicating operations as the molten EM extinguishes the flames and halts the combustion event.

Detonation methods involve the use of a surrogate explosive charge to blast the energetic material away, thus destroying some and spreading the rest over vast distances. This strategy is field-proven in combat zones after transport of the explosives to uninhabited areas. However, situations involving domestic law enforcement operations of homemade explosives (HME) require relocation of the materials to special facilities for controlled detonations. Each scenario requires the availability of suitable modes of transportation and the necessary existence of remote locations, unaffected by ordinances for noise control.

Dissolution or dilution of the energetic material can require the use of copious volumes of liquids, which are not always available at the scene. This method is only a temporary solution to the problem, as the energetic materials can often be re-isolated by evaporation of the solvent. Alternative methods involve the dilution of the energetic materials with inert powders or liquid polymers in order to denaturize them. Another issue is the introduction of the diluted liquid into the ecosystem which could be an undesirable environmental pollutant.

Chemical destruction methods involve the neutralization of energetic materials by the use of chemical or biochemical agents. All known methods first require the dissolution or dilution of the energetic material in either water or a solvent prior to treatment. The second step of this process involves the use of metal catalysts, bases, enzymes, and/or microorganisms to decompose the explosive in the solution, which typically requires several hours.

SUMMARY

The present invention comprises a novel method for the neutralization of energetic materials and associated derivative chemical compounds by the treatment using reactive materials (RM) and formulations thereof.

A second, more specific, objective is to provide a method for the degradation of HMEs, such as those based on AN, UN, erythritol tetranitrate (ETN) and various formulations thereof, and the chemicals involved in their preparation.

In one embodiment, the present invention offers a novel method to promote the rapid combustion of such chemicals based on the use of reactive metal powder mixtures, their alloy compositions and formulations.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 4 presents AN neutralization results at scales ranging from 5 to 50 lbs.

DETAILED DESCRIPTION

Figure 2:
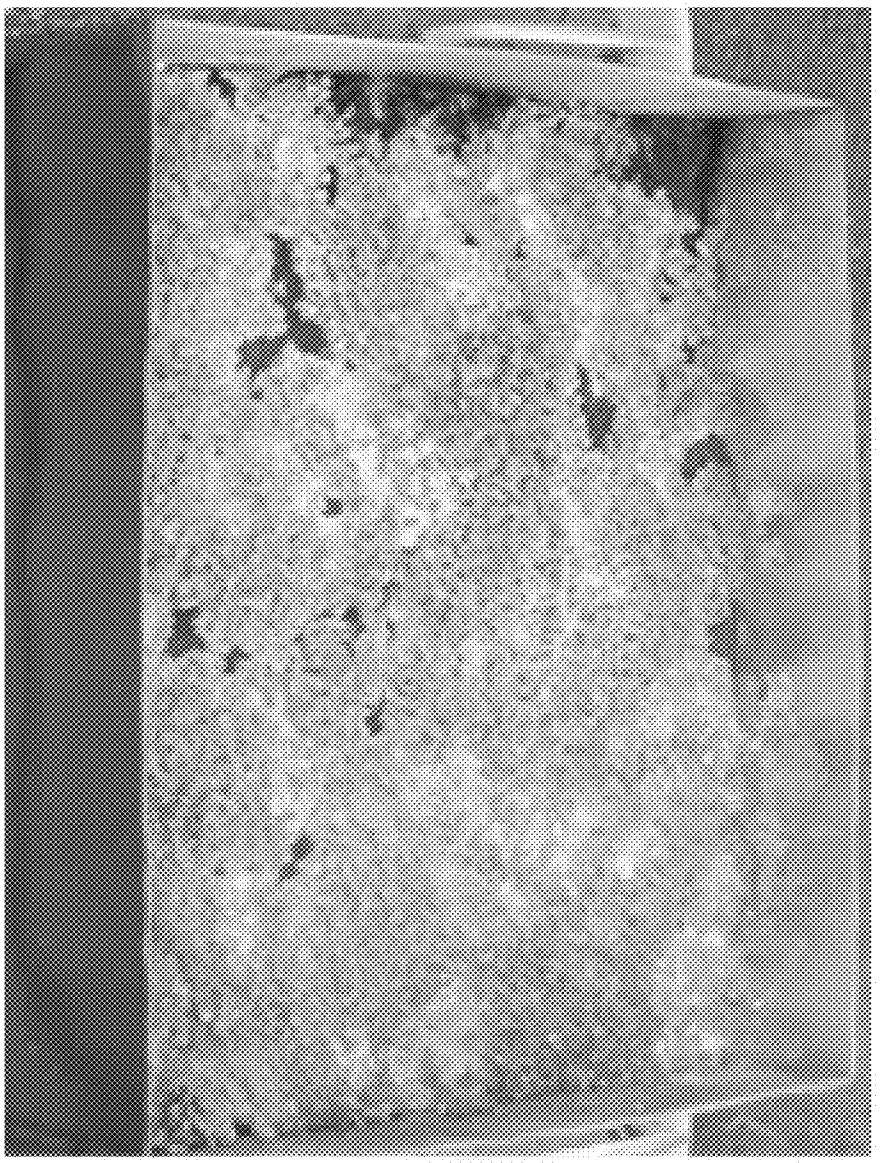
FIG. 2 shows the combustion of 40 lbs of AN by the method presented herein, 15 minutes after ignition.
Figure 3:
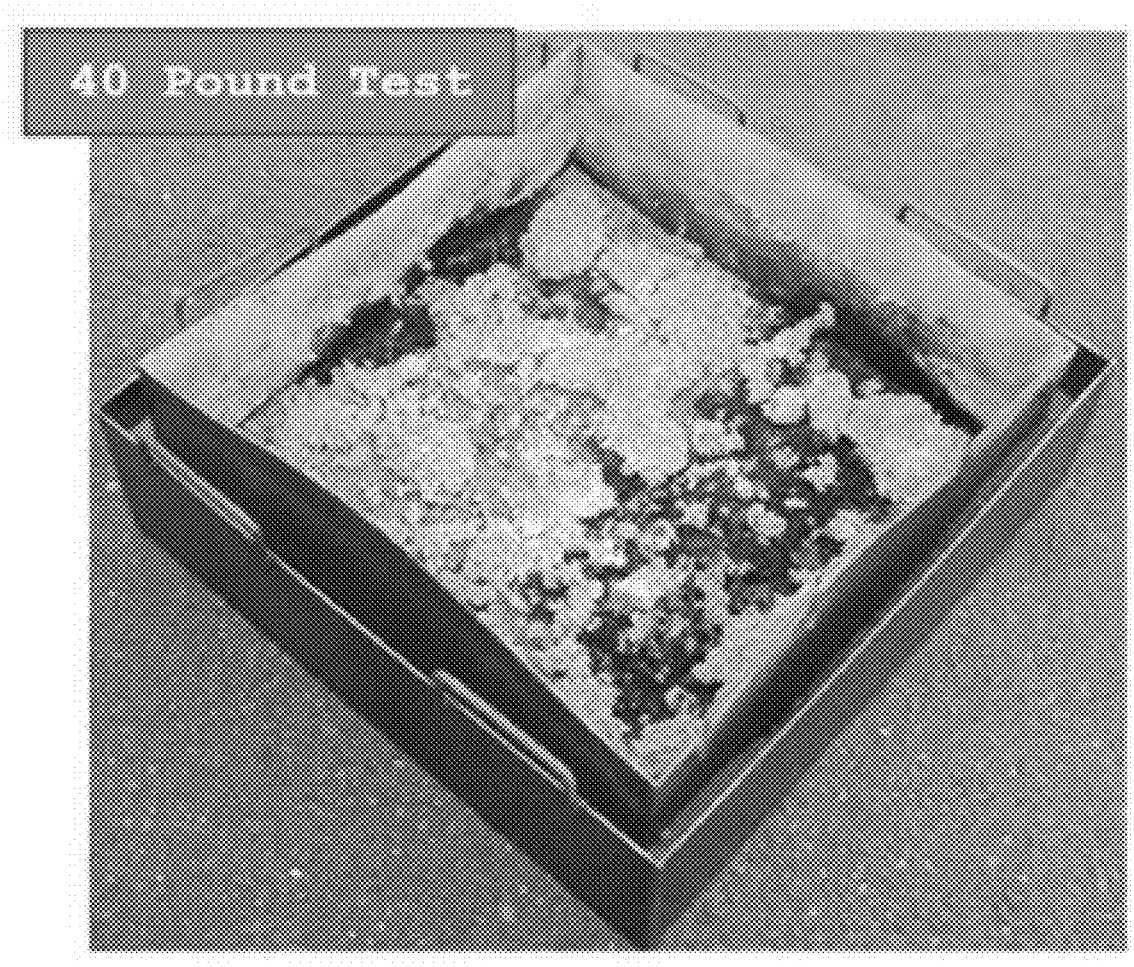
FIG. 3 shows the final state of the AN test at the 40 lbs scale. >95% neutralization was achieved in less than 30 minutes.

The present invention describes the development and use of a novel method for the neutralization of enemetic materials and corresponding constituent precursors via thermal degradation. The invention overcomes problems in the prior art by providing an efficient and reliable method for the controlled combustion of these materials in short times. In the preferred embodiment, the rapid combustion of the energetic material is promoted by the simultaneous and concomitant combustion of an RM or admixture thereof. The RM may comprise a blend of finely divided powders that when ignited results in an exothermic release of energy producing significant amounts of heat. Specifically, the selected RM formulation is placed near, more precisely, deposited on top, around, or below the explosive material or chemical, and the initiation of the combustion of the RM blend promotes the combustion of the adjacent energetic or chemical, as exemplified in a 40-pound proof-of-concept test presented in FIGS. 1 to 3. The RM blend combustion can be initiated by any suitable means that provides an ignition or heat source, such as a flame or an electric spark, brought on by a fuse, electric match, resistively heated hot wire, a flare or any related rapid heat release mechanisms.

The invention presented herein allows for the rapid disposal of various energetic materials via a controlled incineration. Explosive ingredients such as chlorate, perchlorate and nitrate salts of ammonium (AN), urea (UN), sodium and potassium are readily neutralized by the method described. Formulated explosive mixtures of these energetic materials with other components such as sawdust, flour, sugars, oil, metal powders and oil/gasoline are also suitable for neutralization with the current invention. One skilled in the art will recognize that the method can be applied for the disposal of other types of energetic materials, such as nitrocellulose, nitroguanidine, trinitrotoluene (TNT), 1,3,5-hexahydro-1,3,5-trinitrotriazine (RDX), octrahydro-1,3,5,7-tetranitro-1,3,5,7-tetrazocine (HMX), dinitrotoluene, 3-nitro-1,2,4-triazol-5-one (NTO), triaminotrinitrobenzene (TATB) and other chemicals known to deflagrate.

In addition to singular energetic materials, the invention is suited for the neutralization of mixtures of such explosives. In one embodiment, the method allows for the neutralization of energetic materials formulated with filling agents, fuels, diesel or components such as wax, sugar, flour, oil, nitromethane or aluminum. In another embodiment, the invention presented herein allows for the disposal of mixed energetic compositions, such as the ones composed of nitrate, chlorate or perchlorate salts of ammonia or urea mixed with agents such as sugars, gasoline, diesel fuel, flours or sawdust. Such mixtures are widely known to be employed in HME scenarios.

In one embodiment, the current invention relies on uses reactive metal powders, more typically referred to as RMs. Reactive materials can comprise finely divided unary metals or blends of a plurality of admixtures of metals. Examples of combinations of metals that can be utilized as a RM under the present invention include: boron, aluminum, magnesium, iron, cobalt, nickel, titanium, zirconium, hafnium, niobium, tantalum, zinc, and combinations, thereof, in any suitable ratio. In an embodiment, the mass ratio of one metal to another metal, or of one metal to a combination of two or more other metals in the RM, preferably is at least 1:99, at least 2:98, at least 3:97, at least 4:96, at least 5:95, at least 10:90, at least 15:85, at least 20:80, at least 25:75, at least 30:70, at least 35:65, at least 40:60, or at least 45:55. Additionally, the mass ratio of one metal to another metal, or of one metal to a combination of two or more other metals in the RM, preferably is at most 99:1, at most 98:2, at most 97:3, at most 96:4, at most 95:5, at most 90:10, at most 85:15, at most 80:20, at most 75:25, at most 70:30, at most 65:35, at most 60:40, or at most 55:45. Additional RMs may contain other elements such as carbon, nitrogen, boron, chlorine, fluorine, sulfur available in a variety of forms which will be recognized by those skilled in the art.

Another embodiment of the invention features alloys of these reactive metals, with prescribed ratios, such as aluminum-magnesium, zirconium-zinc, aluminum-zirconium, aluminum-titanium, aluminum-hafnium, aluminum-tantalum, aluminum-nickel, aluminum-iron, and other metallic transition elements. Similar combinations exist with magnesium. The enumerated alloys can be used by themselves or in combination with other elemental metals or alloys described herein to provide the requisite RM blend for the intended purpose. In such alloys, the mass ratio of one metal to another metal, or of one metal to a combination of two or more other metals, preferably is at least 1:99, at least 2:98, at least 3:97, at least 4:96, at least 5:95, at least 10:90, at least 15:85, at least 20:80, at least 25:75, at least 30:70, at least 35:65, at least 40:60, or at least 45:55. Additionally, the mass ratio of one metal to another metal, or of one metal to a combination of two or more other metals, preferably is at most 99:1, at most 98:2, at most 97:3, at most 96:4, at most 95:5, at most 90:10, at most 85:15, at most 80:20, at most 75:25, at most 70:30, at most 65:35, at most 60:40, or at most 55:45. The complexity of the formulation allows for adjustments of the total energy output, maximum temperatures attained, and duration of the combustion process among key properties. The careful selection of the constituent metals in this invention allows for the exact tailoring of the temperature and rate of thermal degradation of the specific type of energetic material that needs to be destroyed.

In another embodiment, the metal component can be mixed with an oxidizer to form a the mite mixture. Oxidizers such as bismuth oxide, boron oxide, chromium oxide, manganese oxide, iron oxide and copper oxide can be used with the metal or metal combinations listed above in ratios ranging from 10:1 to 1:10 by mass. In a preferred embodiment, aluminum, zinc or magnesium are mixed with iron oxide, copper oxide or manganese oxide in ratios ranging from 5:1 to 1:5 by mass.

In an embodiment, the generation of the RM formulation can be achieved by blending, mixing, or milling of the constituent elemental metals to intimately mix (down to the atomic scale), altering and refining the precursor particle size, and thus modulating the resultant reactivity. In particular, RM's milled under inert conditions have been shown to have significant increases in reactivity, leading to a more rapid release of exothermic energy per unit time, leading to higher combustion temperatures upon initiation. In an embodiment, the RM formulation preferably comprises particles having a size of at least 10 nm, or at least 0.5 μm. Additionally, the RM formulation preferably comprises particles having a size of at most 200 μm, or at most 50 μm. In a preferred embodiment, the RM formulation comprises particles having a size of 10 nm to 200 μm, more preferably 0.5 μm to 50 μm. It will be recognized by one spilled in the art that the RM formulation can be composed of particles with different particle sizes. In one embodiment, formulations possessing a single particle size distribution, bimodal distributions and ternary particle size distributions are used to modulate the combustion events.

While the previously described embodiments feature the blending of metals as the combustion-facilitating agents, the RM can be formulated with other organic or inorganic additives to further modulate and control the neutralization event. Combustible additives such as wood chips, sawdust, charcoal pellets, carbon powder, coconut shell charcoal, starch, Teflon powder, chaff or wax prills can be used with the RM in mass ratios ranging from 100:1 to 5:1 to 1:1, depending on the application and desired properties for the formulation. In an embodiment, the mass ratio of additive to metal preferably is at least 1:1, or at least 5:1. Additionally, the mass ratio of additive to metal preferably is at most 100:1, or at most 20:1. In a preferred embodiment, the mass ratio of additive to metal is in a range of 1:1 to 100:1, more preferably 5:1 to 20:1. These additives function to augment and enhance the burn characteristics of the overall combustion process, facilitating a cleaner and more complete combustion from reactants to products, along with modulating the length of the combustion event.

Another embodiment features the use of the RM formulation in the appropriate and catalytic quantities to promote the combustion event of the energetic material. Accordingly, the neutralization of the selected explosive can be performed by using as little as one percent by weight of the formulated RM with respect to the weight of the energetic material being neutralized. Higher combustion efficiencies are typically obtained when using between 0.5-20% of RM and between 1-50% of additive with respect to the weight of the energetic material being neutralized. Alternatively, combustion conditions can be optimized by using 1 to 35% of RM with 25-75% of additive relative to the weight of the energetic material to be neutralized. Accordingly, in an embodiment, the amount of RM with respect to the weight of the energetic material preferably is at least 0.5%, or at least 1%. Additionally, the amount of RM with respect to the weight of the energetic material preferably is at most 20%, at most 10%, or at most 5%. In a preferred embodiment, the amount of RM with respect to the weight of the energetic material is in a range of 0.5 to 20%, preferably 1 to 10%, and more preferably 1 to 5%. In an embodiment, the amount of additive with respect to the weight of the energetic material preferably is at least 1%, or at least 5%. Additionally, the amount of additive with respect to the weight of the energetic material preferably is at most 50%, or at most 20%. In a preferred embodiment, the amount of additive with respect to the weight of the energetic material is in a range of 1 to 50%, preferably 5 to 20%.

Figure 1:
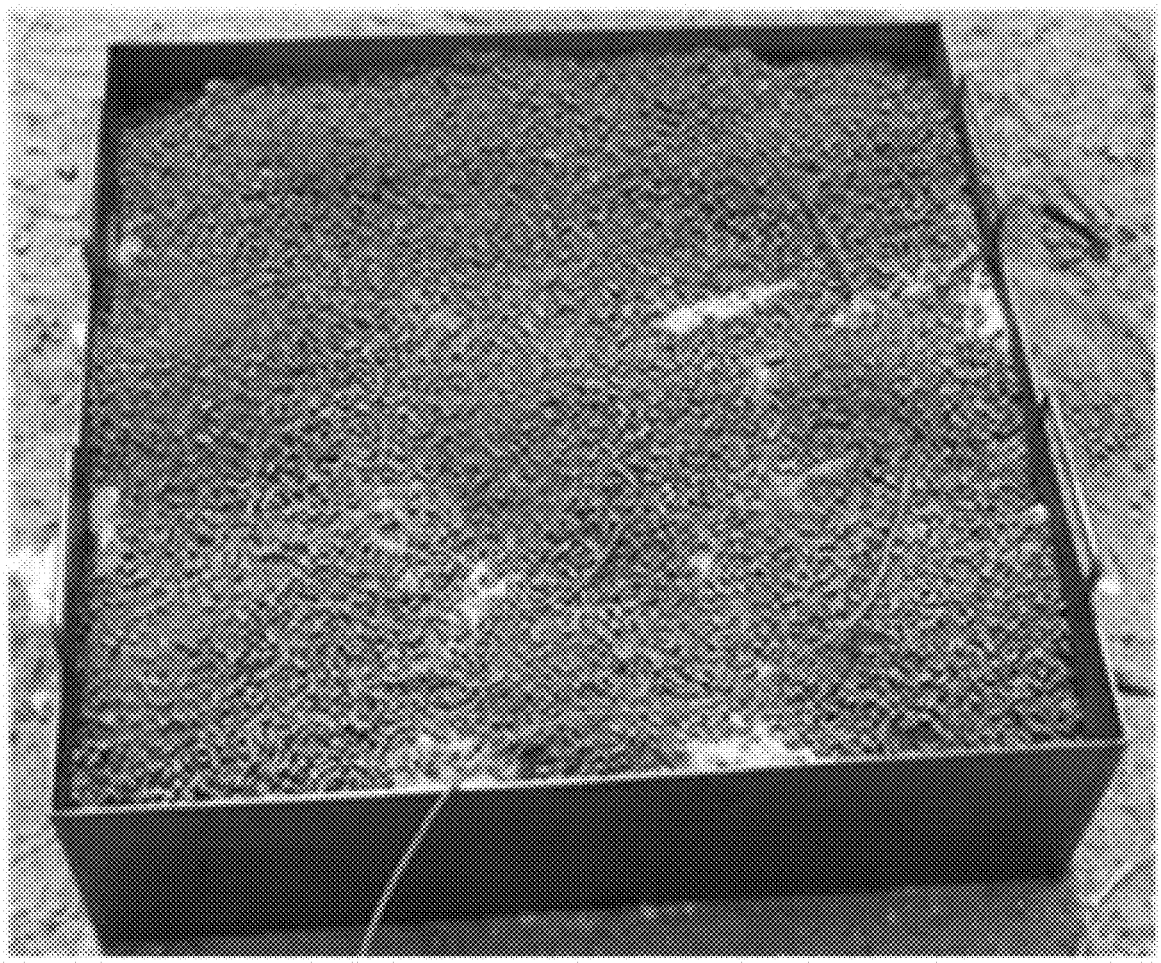
FIG. 1 presents 40 lbs of AN covered with the RM blend described in the current invention prior to ignition with a fuse.

The exemplary configuration of the RM shown in FIG. 1 is a single illustration of many potential methods used to convey the spirit of the inventive concepts described herein. For example, the RM and/or additives can be placed or positioned around, under or above the energetic material to be neutralized. Alternatively, blending the RM formulation with the combustible chemicals will be recognized by one skilled in the art as another proper application method. Another embodiment of the current invention can use two or more separate loadings of the same or distinct RM formulations positioned at different locations within the body of the energetic material in order to modulate the efficiency of the combustion sequence and process. Embodiments include complete coverage of the energetic material by the RM, or partial coverage of the energetic material by the RM. A key aspect of the neutralization method presented in this invention is how it performs in a reproducible manner at different scales, for varying quantities of energetic material, as shown in FIG. 4. The quantity of energetic material to be neutralized effectively by the inventive method may be from a gram to 200 lbs, or even up to 500 lbs.

In one embodiment of the invention, the RM-based formulation is in direct contact with the material to neutralize. Alternatively, the RM formulation can be contained in various packaged forms to facilitate handling and deposition and neutralization operations. In one embodiment, the RM formulation is contained in plastic bags, paper-based or aluminum packaging. Those skilled in the art will recognize complementary packaging system for the RM formulation provided that the packaging material is made of combustible material that doesn't inhibit the ignition and combustion event.

In an embodiment of the inventive method, the energetic material to be neutralized is not dissolved in a solvent (such as water or an organic solvent) and not diluted in a solvent prior to contacting the energetic material with the RM. In another embodiment of the inventive method, the energetic material is dissolved in a solvent or diluted in a solvent prior to contacting the energetic material with the RM. Preferably, the solvent is present in the energetic material in an amount of 15% by weight or less and up to 50% by weight.

Figure 5:
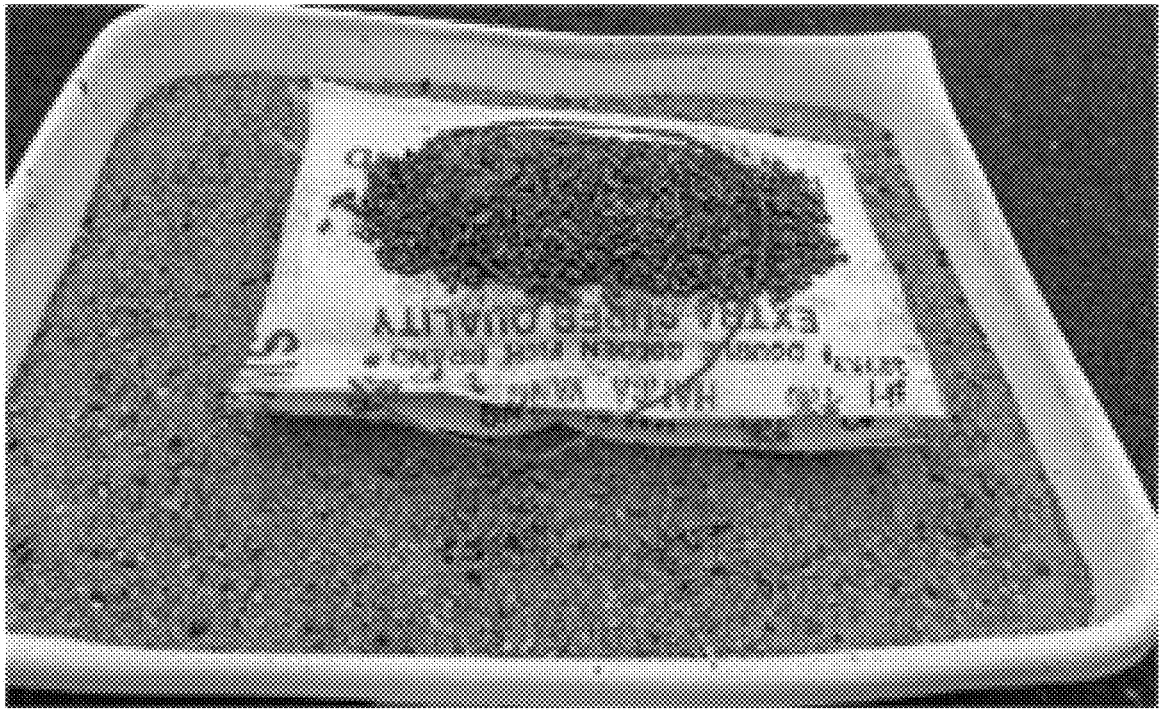
FIG. 5 presents a burn configuration with AN contained in bags, to illustrate the controlled combustion offered by the invention.
Figure 6:
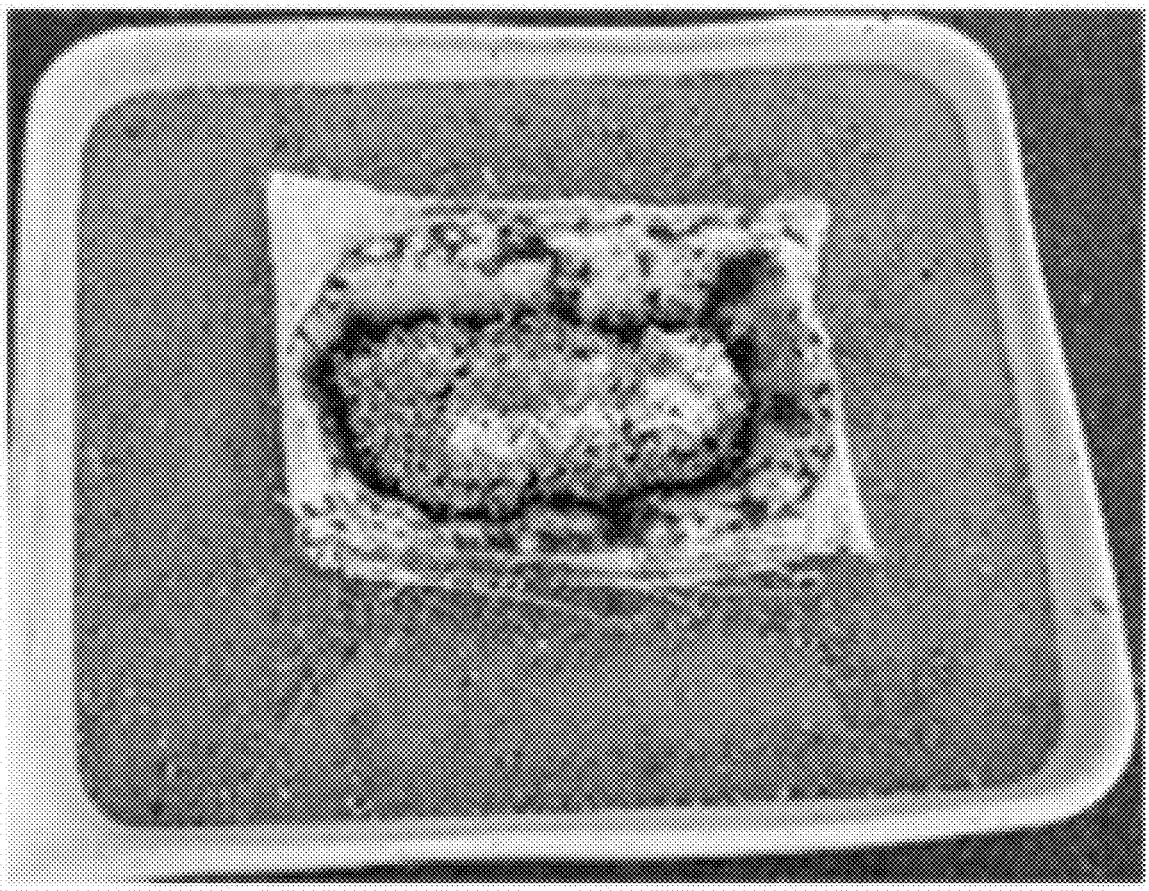
FIG. 6 shows the controlled combustion of AN in bags. Total combustion time of 10 minutes.
Figure 7:
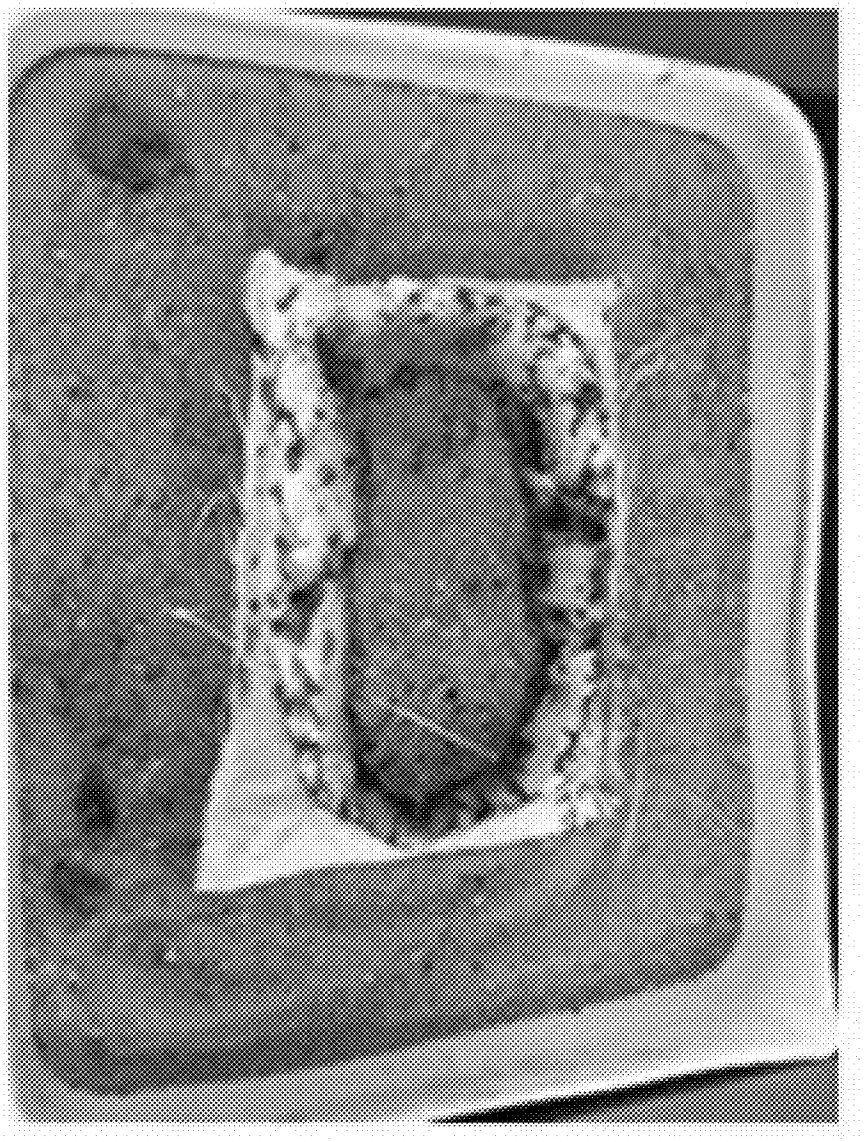
FIG. 7 presents the radius of combustion from the test with AN bags after the combustion byproducts were removed.

A key advantage of the novel method described herein is the ability to neutralize a variety of explosives and energetic material formulations with minimal external damage to the nearby surroundings. Accordingly, FIGS. 5, 6 and 7 present an example of the technique for the controlled combustion of AN contained in bags, as typically found under battlefield scenarios. The demonstration test shows a clear neutralization of the AN with a minimal propagation beyond the RM blend application zone. This is a key attribute of the invention that offers an unprecedented safety margin for the explosive disposal technicians and field operators. This level of control offered by the proposed method should allow for the efficient, rapid and safe neutralization of explosives and energetic materials directly at the location of these materials, thus minimizing safety hazards occasioned by operators during their relocation.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A method for neutralizing energetic materials, their formulations and precursors, comprising the steps of:

contacting an energetic material to neutralize with a formulation comprising one or more reactive materials, arranging the energetic material to neutralize and the one or more reactive materials in a suitable configuration, and igniting the one or more reactive materials to initiate the combustion.

2. The method of claim 1, wherein the formulation of reactive materials consists of a plurality of reactive metals.

3. The method of claim 1, wherein the formulation of reactive materials consists of a plurality of reactive metals and an additive.

4. The method of claim 2, wherein the reactive metals consist of metals in elemental form, alloy form, or a mixture thereof.

5. The method of claim 2, wherein the reactive metals comprise one or more elemental metals selected from the group consisting of boron, aluminum, magnesium, iron, cobalt, nickel, titanium, zirconium, hafnium, niobium, tantalum, zinc, in any suitable ratio.

6. The method of claim 2, wherein the reactive metals comprise one or more alloys selected from the group consisting of an aluminum-magnesium alloy, a zirconium-zinc alloy, an aluminum-zirconium alloy, an aluminum-titanium alloy, and an aluminum-iron alloy.

7. The method of claim 2, wherein the reactive metals are intimately blended or milled prior to producing the formulation in order to reduce particle size and increase activity of the reactive metals.

8. The method of claim 3, wherein the additive comprises one or more components selected from the group consisting of wood chips sawdust, charcoal pellets, carbon powder, coconut shell charcoal, starch, chaff and wax prills.

9. The method of claim 3, wherein the formulation of reactive materials comprises the reactive metal and the additive in a ratio ranging from 1:500 to 50:1.

10. The method of claim 2, wherein the formulation of reactive materials is used in a ratio ranging from 1:100 to 2:1 by weight with respect to the energetic material to neutralize.

11. The method of claim 1, wherein the energetic material to neutralize is selected from the group consisting of ammonium nitrate, urea nitrate, sodium nitrate, potassium nitrate, sodium perchlorate, sodium chlorate, potassium perchlorate, potassium chlorate, nitrocellulose, nitroguanidine, trinitrotoluene, dinitrotoluene, 1,3,5-hexahydro-1,3,5-trinitrotriazine, octrahydro-1,3,5,7-tetranitro-1,3,5,7-tetrazocine, triaminotrinitrobenzene, hexamethylene triperoxide diamine, erythritol trinitrate and 3-nitro-1,2,4-triazol-5-one.

12. The method of claim 11, wherein the energetic material to neutralize is formulated with other energetic materials, filling agents or components.

* * * * *